United States Patent [19]

Murase

[11] Patent Number: 4,676,759

[45] Date of Patent: Jun. 30, 1987

[54] SYSTEM FOR DISCHARGING WATER FROM CRANK CHAMBER

[75] Inventor: Masaaki Murase, Kakogawa, Japan

[73] Assignee: Kawasaki Jukogyo Kabushiki Kaisha, Kobe, Japan

[21] Appl. No.: 828,339

[22] Filed: Feb. 11, 1986

[30] Foreign Application Priority Data

Feb. 13, 1985 [JP] Japan ..... 60-25976

[51] Int. Cl.[4] ..... B63H 21/38

[52] U.S. Cl. ..... 440/88; 114/270; 123/73 R

[58] Field of Search ..... 114/270, 183 R; 440/88, 440/113, 900; 123/73 R

[56] References Cited

U.S. PATENT DOCUMENTS 2,610,602 9/1952 Schenauar ..... 114/183 R 3,763,817 10/1973 Francis ..... 114/183 R 4,461,250 7/1984 Mohr ..... 440/900 X

*Primary Examiner*—Sherman D. Basinger

*Attorney, Agent, or Firm*—Leydig, Voit & Mayer

[57] ABSTRACT

A system for discharging water from a crank chamber of a two-cycle engine of a compression-type crank chamber including a water discharge passageway for communicating a bottom portion of each crank chamber with an outside area, a valve for opening and closing the water discharge passageway, a water discharge pump mounted in the water discharge passageway and a manually operated device for operating the valve and actuating the water discharge pump to discharge water from the crank chamber. The manually operated device includes a lever, a wire connecting the lever to the valve and a switch adapted to be turned on to actuate the water discharge pump as the lever is manipulated.

4 Claims, 5 Drawing Figures

SYSTEM FOR DISCHARGING WATER FROM CRANK CHAMBER

BACKGROUND OF THE INVENTION

This invention relates to a system for discharging water collected in a crank chamber of a compression-type crank chamber two-cycle engine.

One type of small watercraft adapted to be driven by a driver in a standing or sitting position for movement on the water may be constructed such that it can be readily righted when it overturns laterally. When it overturns, water will enter the crank chamber of the compression-type crank chamber two-cycle engine i.e., crankcase scavenged-type through the suction port. When the engine is constructed such that water is injected into the exhaust muffler to silience engine noise, the water might flow backwardly and enter the crank chamber through the combustion chamber. If the water enters the crank chamber, the engine would stop operating and difficulty would be experienced in restarting it.

When this happens, it has hitherto been usual practice to discharge the water collected in the crank chambers by bringing the engine to a tilting position to remove the ignition plug and turning the starter after bringing the engine to an upside down position. This process is troublesome and time-consuming, making it impossible to restart the engine quickly.

SUMMARY OF THE INVENTION

This invention has the purpose of obviating the aforesaid disadvantages of the prior art. Accordingly, the invention has as its object the provision of a system for discharging water from the crank chamber of a two-cycle engine of a compression-type crank chamber capable of readily discharging water from the crank chamber and allowing the engine to be restarted quickly.

To accomplish the aforesaid object, the invention provides a system for discharging water comprising a water discharge passageway for communicating a bottom portion of each crank chambers with an outside area, a valve for opening and closing the water discharge passageway, a water discharge pump mounted in the water discharge passageway, and manually operating means for opening said valve and driving said water discharge pump for operation.

DESCRIPTION OF THE PREFERRED EMBODIMENT

A preferred embodiment of the invention will now be described by referring to the accompanying drawings.

Figure 1:
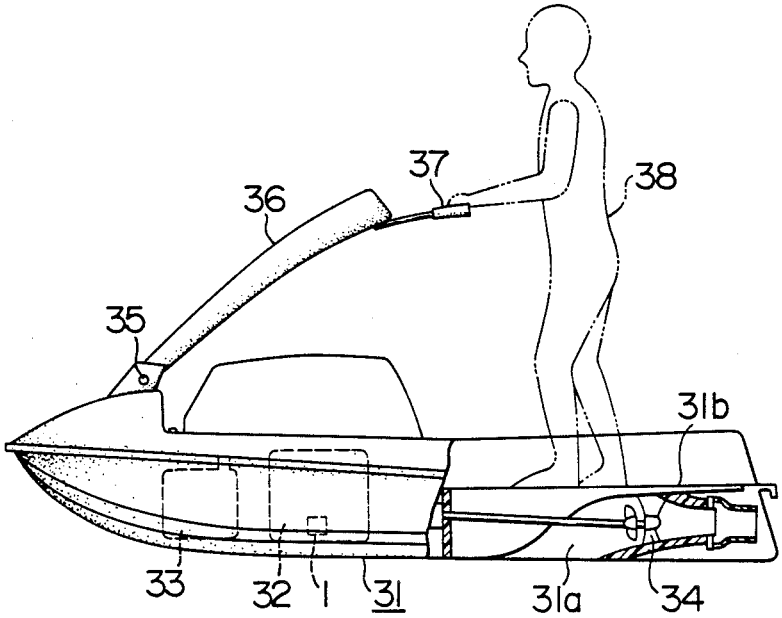
FIG. 1 is a side view, with certain parts being cut out, of a small watercraft provided with a system for discharging water comprising one embodiment of the invention.
Figure 2:
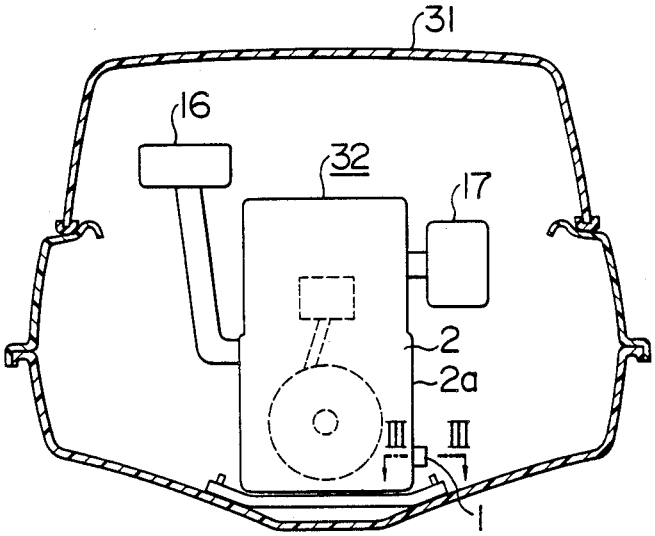
FIG. 2 is a substantially sectional view of the small watercraft shown in FIG. 1.

FIG. 1 is a side view, with certain parts being cut out, showing the general construction of a small watercraft provided with a water discharge system comprising one embodiment of the invention, and FIG. 2 is a substantially sectional view of the small watercraft shown in FIG. 1.

Referring to FIG. 1, a body 31 of the small watercraft formed of fiber-reinforced plastic material has mounted therein a two-cycle engine 32 of a compression-type crank chamber and a fuel tank 33. The engine 32 drives water jet propulsion means 34 mounted in a duct section 33 in a rear portion of the body 31 to provide thrust. A handle pole 36 is connected through a pivot shaft 35 to an upper portion of the body 31 for vertical pivotal movement and has coupled to its rear end a handle bar 37 that can be moved to left and right for steering the watercraft. A driver 38 grips the handle bar 37 to drive the watercraft while standing on a floor 31*b* of the body or sitting thereon. Cooling water is supplied to a muffler 17 (see FIG. 2) after cooling the engine 32.

The small watercraft of the aforesaid construction is provided with valve means 1 located in a lower portion of a side wall 2*a* of the crank chambers 2, as shown in FIG. 2, to cope with the collection of water in the crank chambers 2 that would enter the crank chambers 2 when the watercraft overturns laterally.

Figure 3:
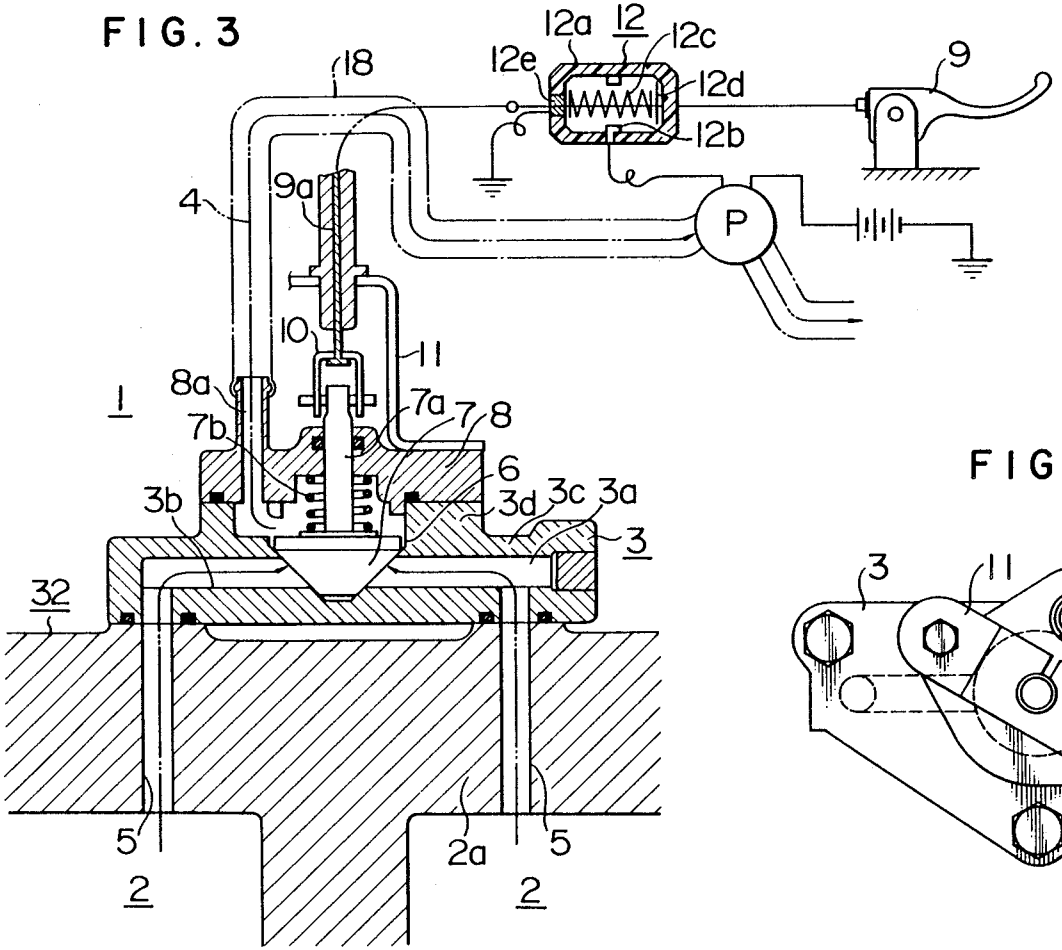
FIG. 3 is a sectional view, on an enlarged scale, taken along the line III—III in FIG. 2.
Figure 4:
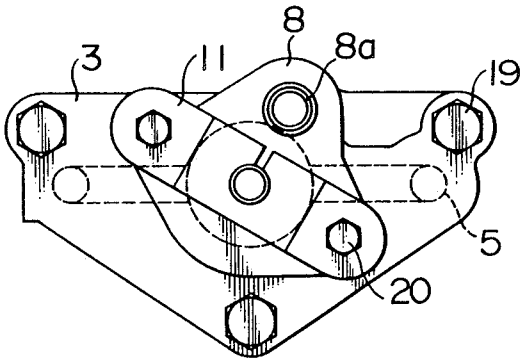
FIG. 4 is a side view of the valve means.

FIG. 3 is a sectional view, on an enlarged scale, taken along the line III—III in FIG. 2, and FIG. 4 is a side view of the valve means 1. In FIG. 3, the engine 32 is a two-cylinder engine and the crank chambers 2 are two in number. Water discharge ducts 5 are formed in the side wall 2*a* of the crank chambers 2, and the valve means 1 is secured to the side wall 2*a* in a position corresponding to the position of the water discharge ducts 5. A passageway 3*a* and an orifice 6 communicating with the water discharge ducts 5 are formed in a lower portion of a support member 3 constituting a lower member of the valve means 1. Secured to an upper portion of the support member 3 is a cover member 8 which is formed with a passageway 8*a* communicating with the orifice 6 and having a pipe 18 connected thereto. The pipe 18 has a forward end portion located inside or outside the hull 31. The water discharge ducts 5, passageway 5*a*, orifice 6 and pipe 18 constitute a water discharge passageway 4 communicating a bottom portion of each crank chamber 2 with an outside area (either the inside or outside of the body 31).

Mounted in the oricice 6 is a valve 7 moved vertically in FIG. 4 by a rod 7*a* which extends through the cover member 8. A spring 7*b* for urging the valve 7 into engagement in the orifice 6 is mounted between a bottom surface of the cover member 8 and a top surface of the valve 7.

The rod 7*a* moves upwardly as a lever 9 serving as an operating member is actuated and moves downwardly under the action of the spring 7*b* when the lever 9 is released. A wire 9*a* connected at one end to the lever 9 is connected at an opposite end to support member 10 for supporting the rod 7*a*. The wire 9*a* is supported at its lower end portion by a holder 11 secured to the cover member 8.

Referring to FIG. 4, the support member 3 is bolted to the side wall 2*a* (see FIG. 3) as indicated at 19, and the cover member 8 is bolted to the support member 3 together with the holder 11 as indicated at 20. The lever 9 shown in FIG. 3 is attached to an outer surface of the handle bar 37 or body 31 shown in FIG. 1.

Mounted in the wire 9*a* is a switch 12 for electrically actuating a water discharge pump P which comprises a fixed contact 12*b* projecting inwardly from an inner wall surface of an insulating case 12*a*, movable contact 12*d* and a spring 12*c* mounted between the movable contact 12*d* and an inner wall surface of the insulating case 12*a*. The movable contact 12*d* extends through a brush 12*e* of conductive material and outwardly of the insulating case 12*a*, and the brush 12*d* is grounded. The wire 9*a* is cut where the switch 12 is located to provide two lengths of wire 9*c*, and one of the two lengths connected to the lever 9 is connected at its severed end to the case 12*a* while the other length connected to the rod 7*a* is connected at its severed end to the forward end of the movable contact member 12*d*.

When the lever 9 is pulled, the insulating case 12*a* is pulled toward the lever 9 to bring the movable contact 12*d* into contact with the fixed contact 12*b*, to render the pump P operative. When the lever 9 is released, the movable contact 12*d* is restored to its original position by the biasing force of the spring 12*c*, to render the pump P inoperative.

Figure 5:
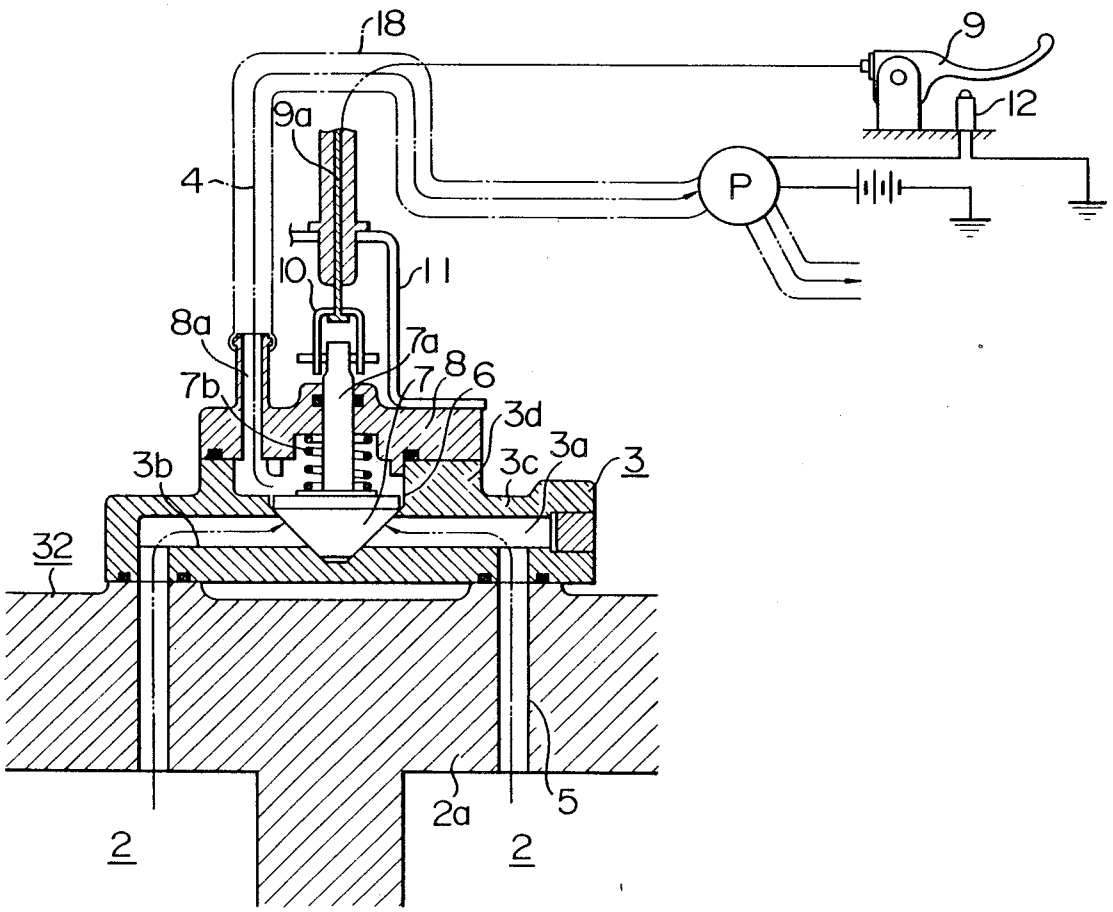
FIG. 5 is a view similar to FIG. 3 but showing another constructional form of switch.

FIG. 5 shows another constructional form of switch 12 which is a position switch located below the lever 9. When the lever 9 is moved downwardly, the switch 12 is pressed by the lever 9 and turned on.

Operation of the system for discharging water from the crank chambers 2 constructed as described hereinabove will be described. If the lever 9 is pulled in FIG. 3, then the valve 7 moves upwardly in the figure to open the orifice 6, and at the same time the pump P is actuated. Stated differently, water collected in the crank chambers 2 after entering through an air cleaner 16 or muffler 17 (see FIG. 2) flows through the water discharge passageway 4 composed of the water discharge ducts 5, passageway 3*a*, orifice 6, passageway 8*a* and pipe 18, to be discharged into or out of the body 31. The water discharged into the hull 31 is released therefrom by means of a bilage discharge device, not shown, which utilizes a negative pressure produced by the water jet propulsion means 34.

The invention has been described as being applied to a small watercraft. However, the system for discharging water from the crank chambers described hereinabove can also have application in ordinary 2-cycle engines of the crank chamber compression type to discharge from the crank chambers rain water which might be collected therein.

From the foregoing description, it will be appreciated that the present invention enables the water collected in the crank chambers to be readily discharged therefrom without requiring to remove the engine from the position in which it is supported, thereby enabling the engine to be restarted quickly.

What is claimed is:

1. A system for discharging water from a crank chamber of a compression-type crank chamber two-cycle engine comprising:

a water discharge passageway connecting a bottom portion of the crank chamber with the outside area;

a valve for opening and closing said water discharge passageway;

an electrically actuated water discharge pump mounted in said water discharge passageway; and common manually operated means for opening said valve and for electrically actuating said water discharge pump to discharge water from the crank chamber through the open valve and passageway.

2. A system for discharging water from a crank chamber of a two-cycle engine as claimed in claim 1 wherein said common manually operated means comprises a lever adapted to be manually operated and a switch for electrically actuating said pump operated by said lever, and a wire connecting said lever to said valve.

3. A system for discharging water from a crank chamber of a two-cycle engine as claimed in claim 2 wherein said switch is connected to be opened and closed for actuating and deactuating said pump as said wire is moved.

4. A system for discharging water from a crank chamber of a two-cycle engine as claimed in claim 2 wherein said switch comprises a two position switch mounted to be depressed to a closed position from an open position for actuating said pump by operation of said lever to open said valve.

* * * * *